US007192624B2

(12) United States Patent
Shtikan et al.

(10) Patent No.: US 7,192,624 B2
(45) Date of Patent: Mar. 20, 2007

(54) METHOD FOR OBTAINING THERMAL DIFFUSION COATING

(75) Inventors: Isaac Shtikan, Petach Tikva (IL); Josef Almen, Ariel (IL)

(73) Assignee: Distek, Ltd., Barkan (IL)

( * ) Notice: Subject to any disclaimer, the term of this patent is extended or adjusted under 35 U.S.C. 154(b) by 207 days.

(21) Appl. No.: 10/451,731

(22) PCT Filed: Dec. 26, 2000

(86) PCT No.: PCT/IL00/00841

§ 371 (c)(1),
(2), (4) Date: Oct. 24, 2003

(87) PCT Pub. No.: WO02/052057

PCT Pub. Date: Jul. 4, 2002

(65) Prior Publication Data

US 2004/0062859 A1 Apr. 1, 2004

(51) Int. Cl.
*C23C 16/00* (2006.01)

(52) U.S. Cl. ..... 427/251; 427/252; 427/255.5; 118/717; 118/729; 118/730

(58) Field of Classification Search ..... 118/717; 427/251, 252, 255.5
See application file for complete search history.

(56) References Cited

FOREIGN PATENT DOCUMENTS

| | | | |
|---|---|---|---|
| GB | 2082299 | * | 3/1982 |
| JP | 07-173605 | * | 7/1995 |
| RU | 2031186 | * | 3/1995 |
| RU | 2130508 | * | 5/1999 |

* cited by examiner

*Primary Examiner*—Richard Bueker
(74) *Attorney, Agent, or Firm*—Blank Rome LLP

(57) ABSTRACT

Continuously operating furnace and method for obtaining thermal diffusion coating on the outside surface of metallic articles. The furnace is configured as a tunnel through which in succession are advanced closed containers filled with the processed articles and with powder mixture, containing diffusing specie. A chain conveyor, passing through the furnace, advances the containers along a transportation path. The furnace is provided with plurality of stopper means, capable to intermittently prevent the advancement of the containers and to retain them in discrete positions, situated along the transportation path. The containers advance in parallel being always directed perpendicularly to the transportation path and their retention in the discrete positions causes their rotation about their longitudinal axes. Continuous operation is associated with improved efficiency and increased capacity.

15 Claims, 7 Drawing Sheets

METHOD FOR OBTAINING THERMAL DIFFUSION COATING

FIELD OF THE INVENTION

The present invention relates to the surface treatment technology, wherein an external protective and/or decorative layer is created on the surface of metallic component. More particularly, the present invention refers to thermal diffusion coating technology, in which the external layer is created on the surface of the metallic component by diffusing thereinto suitable specie, which is metal or element. The diffusing specie in combination with the solvent metal or alloy from which the component is manufactured, provides a coating thereon, having the required resistance to the corrosive medium or imparting to the component the required external appearance. The other term used in connection with this technology is pack cementation.

Usually thermal diffusion coating process utilizes zinc diffusion to apply zinc coating on components made of ferrous materials like iron, low-carbon steels, medium carbon and alloy steels, high carbon steels and cast irons. This process is known also as sherardizing, named after its English inventor, Sherard O. Cowper-Coles. This term means formation of a uniform corrosion-resistant coating of zinc on the surface of iron or steel components by heating them in a sealed container. The components are embedded in finely divided zinc powder and heated to a temperature, corresponding to the point at which zinc melts, usually at 350–450° C. Since the component to be coated is covered by zinc powder to provide close intimate contact therewith, heating up to this temperature is accompanied by diffusion of zinc atoms into the bulk of the object and formation of external coating layer. This layer consists either of pure zinc or of its alloys with the atoms of the host component. The coating is corrosion-resistant; it has good appearance and makes a good paint base. Due to the small dimensional changes involved in this process it is of particular value for the treatment of small parts, e.g., bolts, nuts, bushings, and small hardware articles such as hose clamps and electrical components, etc.

The present invention refers mostly to the thermal diffusion process for manufacturing zinc coatings; however, it should not be considered as restricted exclusively to zinc coatings. The present invention applies also to thermal diffusion of aluminium, nickel, copper or other species, including metals or non metals so as to make coatings on components made of ferrous or non-ferrous metals and alloys.

The present invention relates in particular to a new method of thermal diffusion coating and a new apparatus for its implementation.

BACKGROUND OF THE INVENTION

A general description of the sherardizing process can be found in numerous technical monographs or handbooks. See, for example, the monograph "Corrosion and protection of metals" by Bakhvalov and Turkovskaya, Pergamon Press, 1965.

The typical sherardizing process described in this monograph involves the following three main steps:

a) Cleaning of articles by sandblasting;

b) Loading of cleaned articles into closable receptacle together with a powder mixture, comprising zinc powder;

c) Thermal treatment of the receptacle within a furnace.

The last step consists of slow heating of closed receptacle to 440° C. and holding thereof at that temperature for several hours.

There are known in the art various furnaces, in which the above-mentioned thermal treatment step can be carried out. For example, in RU2031186 and RU2130508 are disclosed periodically operating furnaces, in which closed receptacle is placed and heated. The receptacle is formed as elongated tubular, preferably cylindrical container. The parts to be coated are loaded within the container together with the zinc containing powder. During the thermal treatment the receptacle is rotated about its longitudinal or transversal axis. The advantage of the above-mentioned devices is associated with rotational movement of the receptacle. By virtue of rotation the powder more efficiently mixes with the loaded articles and this improves the homogeneity of diffusion and so the quality of the obtained coating. The disadvantage of the above-mentioned furnaces is associated with the fact that they operate periodically and therefore changing the amount of supplied thermal energy creates temperature gradient within the heating zone. This fact is associated with the necessity to wait until the process is fully completed before the new container enters the furnace. It can be readily appreciated, that the disadvantage of periodically operating furnace is associated with insufficient efficiency and capacity. Furthermore the maintenance of periodically operating furnace is complicated due to the necessity to repeat the same operations during each run.

In JP7173605 is described a furnace for carrying out of pack cementation. This furnace comprises an inlet chamber for loading containers with articles packed in the cementation powder, a heating chamber and a cooling chamber. The containers are configured as rectangular boxes, which are not tightly closed. Plurality of containers is transferred in sequence from the inlet chamber to the heating chamber and then to the cooling chamber. This furnace operates continuously, however it is not suitable for carrying out the sherardizing process, since it is designed to heat opened container, which is advanced strictly along the furnace and without a possibility for any additional movement.

In GB2082299 is described continuously operating heat-treatment furnace for pipes. This furnace comprises a furnace chamber for heating a plurality of pipes, arranged in parallel and transportable by a chain conveyor along the furnace. The pipes are oriented within the chamber in such a manner, that their longitudinal axes are perpendicular to the transport direction. There are provided plurality of stopper means for stopping the pipes intermittently at spaced-apart positions in the path of transport. The stopping causes each of the pipes to rotate about its own axis in co-operation with the chain conveyor. Pipes can be heat-treated in succession with a high efficiency. The force of transport of the chain conveyor causes the pipe to rotate once it reaches the stopper means and there is no necessity in any additional device for the rotation. In the above furnace the thermally treated objects are pipes opened from both ends and their rotation is utilized for preventing thermal deformation to an elliptical shape. Unfortunately the furnace, disclosed in the above patent is not designed and is not suitable for thermal treatment of parts, placed in sealed tubular containers, as it is required for thermal diffusion coating.

It should be pointed out that despite the process of thermal diffusion coating as such is known for a long time and there are known various furnaces, devised for carrying out this process, nevertheless there is still felt a strong need in a new and improved furnace, which is dedicated to this process and is free of the above-mentioned disadvantages of the known in the art devices.

OBJECTS OF THE INVENTION

The main object of the present invention is to provide a new method for carrying out the thermal diffusion coating and a new furnace for its implementation in which the above-mentioned drawbacks are sufficiently reduced or overcome.

In particular, the main object of the present invention is to provide a new apparatus and method for thermal diffusion coating, which operates continuously and has improved capacity in comparison with periodically operating furnaces.

The further object of the present invention is to provide a new and improved apparatus and method for continuous thermal diffusion coating, in which closed tubular container could be advanced through the furnace and heated, while efficient intimate contact between the articles and powder mixture is maintained during the carrying out the process.

The third object of the invention is to provide a new and improved apparatus for continuous thermal diffusion coating, which is simple, reliable and inexpensive.

The above and other objects and advantages of the present invention can be achieved in accordance with the following combination of its essential features, referring to the different embodiments thereof.

According to the embodiment of the invention, referring to an apparatus for obtaining thermal diffusion coating on the outside surface of articles of manufacture, wherein the articles are heated within a closed tubular container, said articles are embedded in a powder mixture, containing a specie, capable upon heating to diffuse within the articles surface, said apparatus comprises:

a. thermal treatment chamber suitable for placing thereinto of at least one container with the said articles and heating thereof up to the temperature sufficient to initiate and maintain the said diffusion, said thermal treatment chamber is configured as a tunnel defined by parallel lateral walls, by a bottom and by a ceiling, the interior of said tunnel is provided with a heating zone heated by heating means, said chamber is closed at one end thereof by an inlet door and at the opposite end thereof by an outlet door, b. advancement means, capable to continuously advance the container along the transportation path so as to bring it within the tunnel, to advance it along the tunnel and to evacuate it from the tunnel, c. at least one stopper means situated along the transportation path, said stopper means is capable to intermittently prevent the advancement of the container along the transportation path and to cause rotation thereof about its longitudinal axis once the container approaches the stopper means d. a source of power for energizing the heating means e. appropriate control and instrumentation means for controlling the power supply and the other components so as to carry out the required heating schedule.

According to the embodiment of the invention, referring to a method for obtaining thermal diffusion coating on the outside surface of articles of manufacture by heating thereof within a furnace, while said articles are placed within a closed tubular containers and embedded within a powder mixture, containing a specie, capable upon heating to diffuse within the articles surface, said method comprises:

a) continuous advancement of the closed containers in succession along a transportation path so as to bring the said containers within the furnace, to heat them therein and to evacuate them therefrom, said advancement is carried out in such a manner that said containers are advanced in parallel fashion being directed perpendicularly to the longitudinal axis of the furnace b) intermittent preventing of the said advancement along the transportation path and c) rotation movement of the said containers about their longitudinal axes when the said advancement is prevented.

The present invention has been only briefly summarized with reference to its two main embodiments as an apparatus and as a method.

For better understanding of the invention in connection with its further embodiments complementing the above, as well of the advantages of the invention, reference will now be made to the following description of the main and complementing embodiments with reference to the accompanying drawings.

DETAILED DESCRIPTION OF SPECIFIC EMBODIMENTS

Figure 1A:
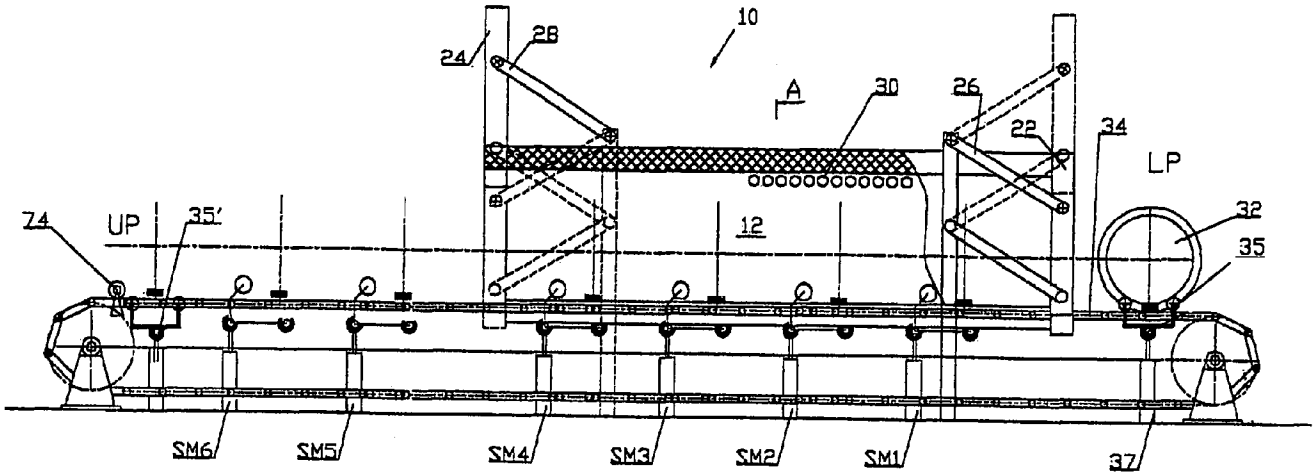
FIG. 1*a* shows partially cross-sectioned side view of the apparatus of the invention.
Figure 1B:
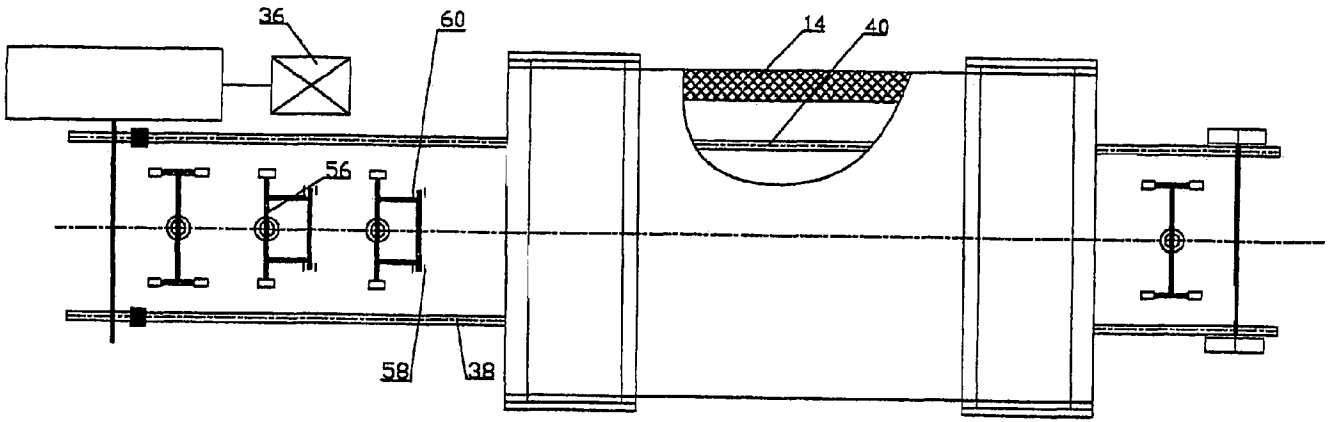
FIG. 1*b* shows upper view of the apparatus of the invention.

Referring to FIGS. 1,2 it is shown the apparatus 10 of the invention, configured as a furnace, comprising a heating chamber 12, which is defined by parallel lateral walls 14, 16, a bottom 18 and a ceiling 20. It is not shown specifically but should be understood, that the walls of the chamber are made of appropriate refractory material and are thermally insulated.

The chamber is provided with an inlet door 22 and an outlet door 24, which could be opened and closed by appropriate driving mechanism (not shown in details). In FIG. 1*a* is seen that for opening and closing the inlet and outlet door a dedicated pantograph mechanism 26,28 is employed.

On the ceiling of the heating chamber are mounted electrical heating elements 30, which are energized by appropriate power supply (not shown). The preferred type of heating energy is electrical, however other sources of energy and appropriate heating means could be used as well.

Before the input door a container 32 is seen, residing in initial position, ready for bringing thereof into the chamber. The container is filled with the articles to be coated and is tightly closed by a cover C.

It is not shown specifically but should be understood, that container is filled also with a powder mixture, containing specie, capable to diffuse within the article's outside surface upon heating up to the temperature required for initiation and maintaining the diffusion. The articles are embedded within the powder mixture to provide intimate contact with the particles of the powder mixture and thus to facilitate the diffusion. When the container is brought within the heating chamber the heating elements provide necessary heat for initiation the diffusion. Upon completing the diffusion the container is evacuated from the heating chamber, is cooled outside and ready coated articles are discharged therefrom.

In contrast to the known in the art heating chambers employed for carrying out the diffusion coating process, in which the container is stationary during the process the heating chamber of the present invention is configured as elongated tunnel, along which the container is advanced during the heating. The container is brought in the heating chamber through the inlet door and is evacuated from the chamber through the outlet door. It can be readily appreciated that in this embodiment the apparatus of the invention in fact constitutes a continuously operating furnace, which heating chamber is configured as a tunnel. For bringing the container within the chamber, advancing thereof along the chamber and evacuating thereof from the chamber there is employed a conveyor 34, extending along the longitudinal axis of the chamber. The conveyor starts before the inlet door at the outside loading position LP, passes along the tunnel's interior and terminates at the outside unloading position UP, situated beyond the outlet door. For advancing the conveyor a dedicated drive 36 is provided. In the further disclosure the route from the loading position and up to the unloading position will be referred to as the transportation path. At the beginning of the transportation path, i.e. in the loading position LP is arranged a platform 35 for receiving new container to be processed in the heating chamber. A cylinder 37 is provided, which can lift or lower the platform with respect to the conveyor. After the fresh container is put on the platform by appropriate loading device (not shown) it can be easily put on the conveyor by lowering the platform below the conveyor level. Similar platform 35' is arranged at the end of the transportation path in the unloading position UP. Lifting this platform disengages the conveyor from the container and appropriate hoist or forklift can easily evacuate it.

The conveyor consists of at least two parallel chains 38, 40, advanced by the drive within the corresponding slots 42,44, made in the furnace bottom and situated close to the lateral walls of the heating chamber. The chains consist of plurality of links 45 connected by pins P.

Figures 2A, 2B, 2C:
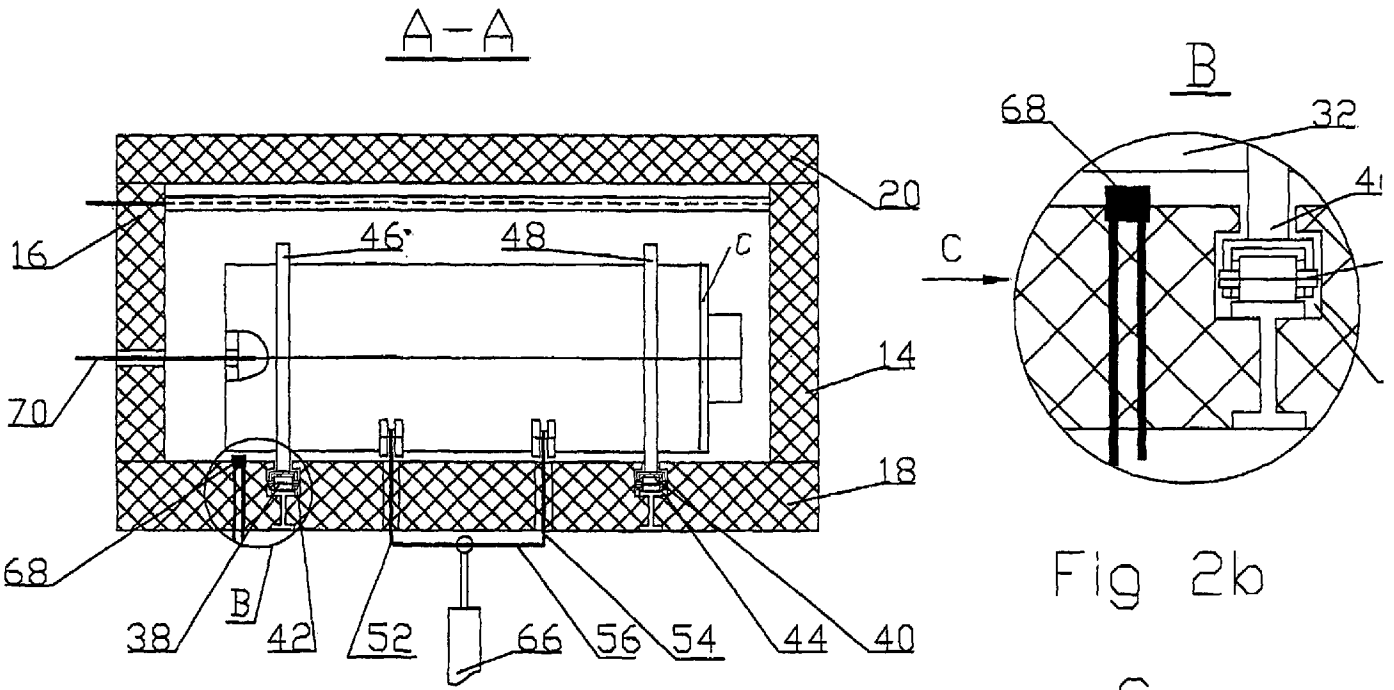
FIG. 2*a* is cross-sectional view of the apparatus seen in FIG. 1*a* taken along A—A.
FIG. 2*b* is enlarged view of detail B, circled in FIG. 2*a*.
FIG. 2*c* is partial enlarged view of the chain conveyor.

As best seen in FIG. 2*a* the container is formed as cylindrical body provided with two annular protrusions 46,48 spaced-apart along the peripheral surface thereof. The distance between the protrusions is made corresponding to the distance between the chains. By virtue of this provision the container rests on the chains and is advanced along the transportation path while being directed perpendicularly to the transportation path. Furthermore, since the protrusions enter into the slots of the bottom this orientation of the container always remains when the container advances along the transportation path within the furnace.

Residing under the conveyor a plurality of stopper means SM1, SM2, SM3, SM4, SM5, SM6 is provided, which are disposed in discrete locations along the transportation path and divide it accordingly into plurality of discrete positions. The discrete positions are situated along the whole transportation path, including the heating chamber. Particular construction of the stopper means as well the significance of the discrete positions will be explained in details further. The purpose of the stopper means is to prevent intermittently the advancement of the container along the transportation path without however discontinuation the advancement movement of the conveyor. The stopper means are capable to rise above the conveyor or to go down beneath the conveyor. Rising of stopper means is associated with retaining the container in a discrete position, while lowering of stopper means is associated with restoration of the advancement of the container along the transportation path. Since container always is directed perpendicularly to the transportation path, it is forced to rotate along its longitudinal axis, when it reaches a discrete position, in which the stopper means prevent its advancement along the transportation path. By virtue of this provision the powder mixture and the articles within the container are intensively mixed and are brought in a very intimate contact. It can be easily appreciated that when the container means rotates within the heating chamber the mixing intensifies the diffusion and thus improves the quality and homogeneity of the diffusion coating. On the other hand since the conveyor continuously brings new containers in succession within the heating chamber the capacity of the furnace significantly increases without however to deteriorate the quality of the coating.

Having described in general the principle of operation of the furnace of the invention it will be disclosed now the construction of stopper means.

Figure 3B:
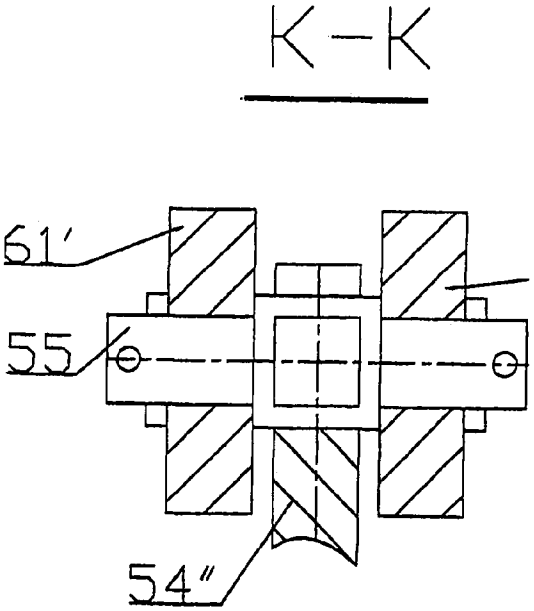
FIG. 3*b* is partial cross-sectional view of the stopper means seen in FIG. 3*a* taken along K—K.
Figure 3A:
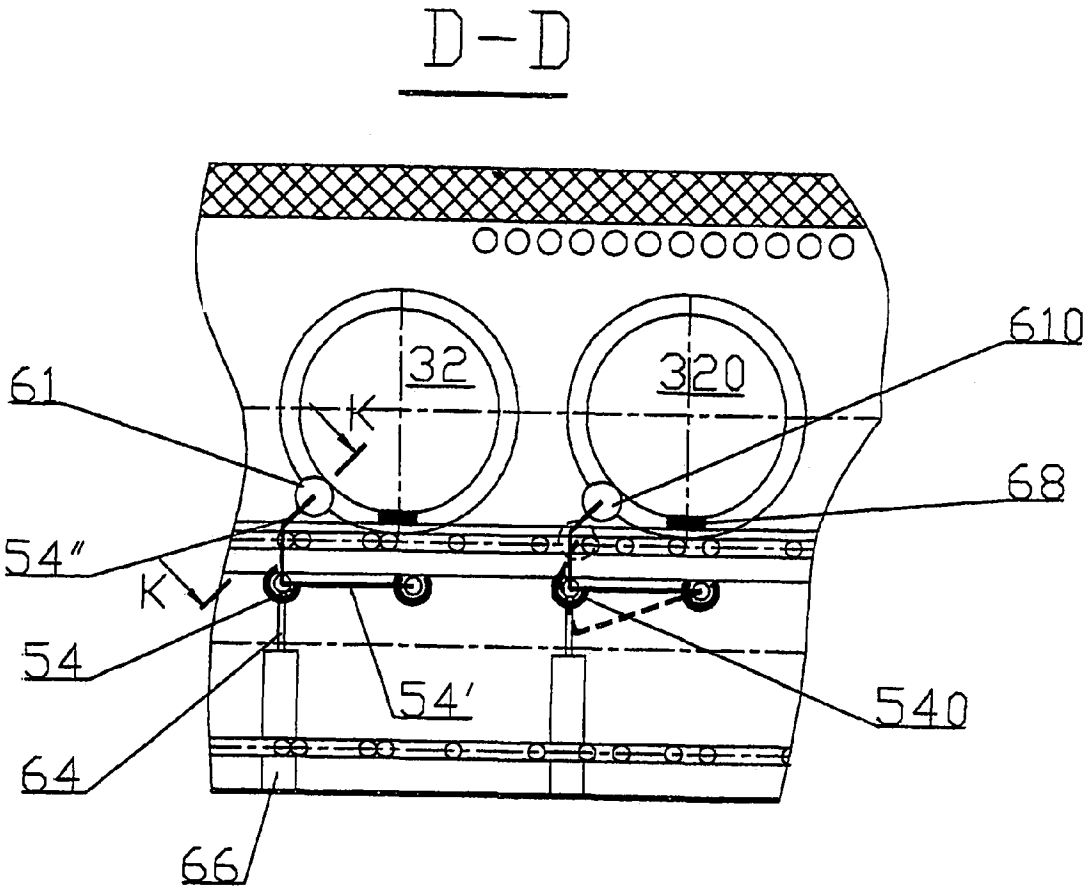
FIG. 3*a* is partially cross-sectional view of the apparatus, shown in FIG. 2*a* taken along D—D.

As explained above the stopper means are designed to discontinue intermittently the advancement movement of the container along the transportation path and to cause its rotation above the longitudinal axis. Referring to FIGS. 1,2,3 it is shown that each stopper means comprises two L-shaped levers 52,54, which are rigidly secured on an axle 56 in a spaced-apart fashion. Each lever consists of two branches, which are substantially perpendicular to each other. In FIG. 3*a* the branches of lever 54 are designated at 54',54".

The axle is directed perpendicular to the transportation path and is mounted under the bottom of the furnace with possibility for rotation in bearings 58,60. The distance between the axle and the bottom as well the configuration of the levers are selected in such a manner, that one of their branches can either to protrude above the bottom of the furnace and thus to prevent the advancement of the container along the transportation path or to be lowered under the bottom and thus to allow further advancement of the container. Since the levers are spaced-apart along the axle their protruding branches touch the peripheral surface of the container in two spaced-apart locations and thus efficiently prevent advancement of the container. The protruding branches of the levers are provided with rollers 61,61', sitting with possibility for rotation on a common axis 55. It can be appreciated that when the container reaches the rollers it is forced to rotate about its longitudinal axis, since the conveyor tries to advance the container further against the levers. The rollers contacting the container's periphery rotate together with the container. This situation is depicted in FIG. 3*a*, in which are seen containers 32,320, which are stopped by levers 54, 540 correspondingly and which rotate together with rollers 61,610.

Axle 56 is connected to a piston rod 64, driven by a cylinder 66. By virtue of this provision the axle can be rotated clockwise or anticlockwise, when the cylinder pushes or pulls the rod. It can be appreciated, that rotating of the axle is associated with pivoting of the levers sitting thereon and thus with bringing the levers either in the protruding position, shown in FIG. 3*a* by solid lines or in the lowered position shown by dotted lines. In each of the above position the levers are reliably retained by virtue of rod 64, connected to the axle. It should be understood that all stopper means are similar and above explanation refers to each of them.

As mentioned above the apparatus of the invention is provided with plurality of stopper means, dividing the transportation path into plurality of discrete positions. Some of the stopper means are disposed under the bottom of the furnace. These stopper means are seen in FIG. 1*a* and they divide the heating chamber into four positions. The other two stopper means are situated outside the furnace, before the unloading position UP. These stopper means divide the transportation path outside the outlet door into two position. In the further disclosure those positions, which refer to the heating chamber will be referred to as heating positions and those positions, which are outside the heating chamber will be referred to as cooling positions. Altogether the transportation path is divided into eight discrete positions, i.e. loading position, four heating positions, two cooling positions and one unloading position. It should be understood that the above division is not compulsory and can vary in accordance with requirements of the diffusion coating process, dimensions of the furnace, type of the articles to be coated, required capacity, etc.

Each discrete position, associated with its stopper means is provided with a dedicated sensor means 68, capable to detect the presence of a fresh container in this discrete position and to generate appropriate signal thereupon. The sensor means is electrically connected with automatic and control system (not shown), which upon receiving signal from the sensor means operates cylinder 66 and other components of the furnace. Once the cylinder is activated it rotates axle 56 and urges levers 52,54 to pivot. By virtue of this provision the container can be either intermittently stopped in the discrete position or released therefrom.

It is not disclosed specifically but should be understood that there is also provided appropriate control panel with necessary instrumentation, which is required both for running the furnace and for automatic control the processing cycle.

As best seen in FIG. 2*a* there is provided a thermocouple 70, which protrudes through lateral wall 16 towards the bottom of the container to allow temperature measuring within the container. It is advantageous if a small through going hole or depression is made in the container's bottom for receiving the thermocouple. Once the container is in the heating position the thermocouple is inserted in the opening and it is ready for measurement the temperature in the container. Since the power supplied to the heating elements is controlled according to the temperature within the container it is possible to control the thermal diffusion process more accurately. When the heating time is over the thermocouple is evacuated from the container and it can be advanced further along the transportation path. Instead of the thermocouple, which is insertable in the container it is possible to employ several thermocouples, stationary mounted on the ceiling of the furnace in several heating positions to protrude towards the container's periphery.

Now with reference to FIGS. 4–10 the functioning of the apparatus of the invention will be explained. It is possible to run the furnace either in automatic or manual mode. The manual mode will be explained first.

Figure 4:
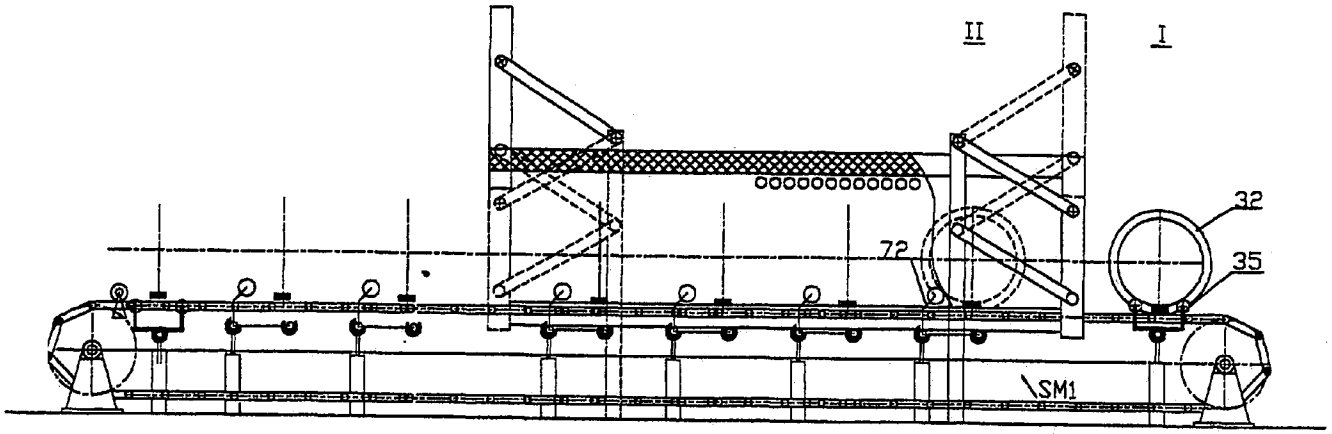
FIGS. 4–10 show consequent steps of the process carried out continuously.
Figure 5:
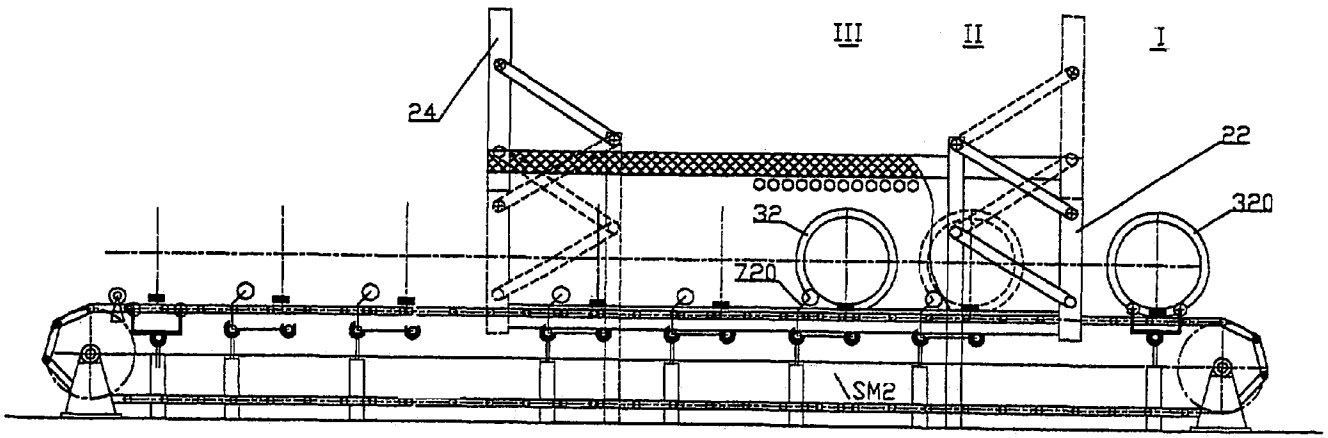
Figure 6:
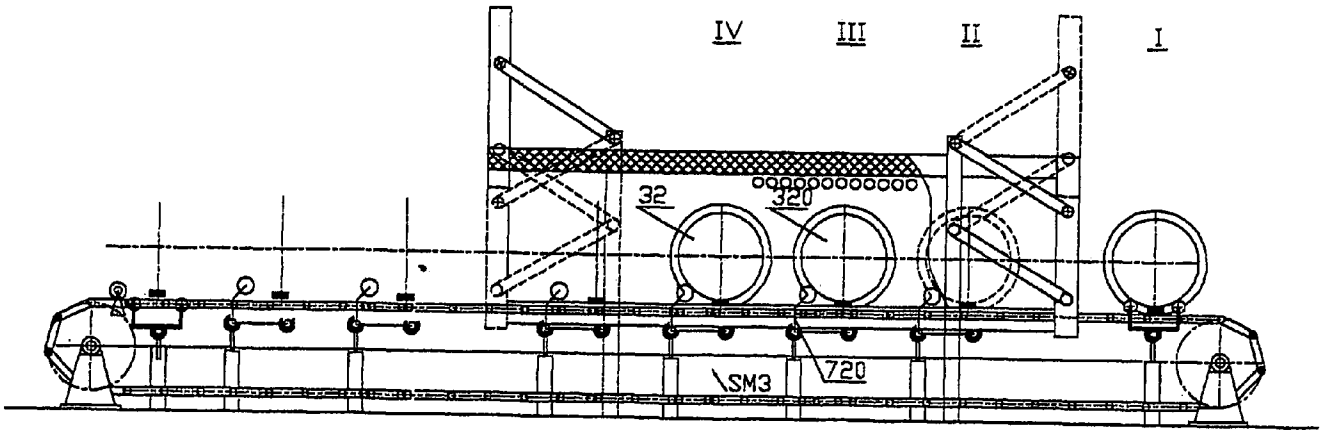
Figure 7:
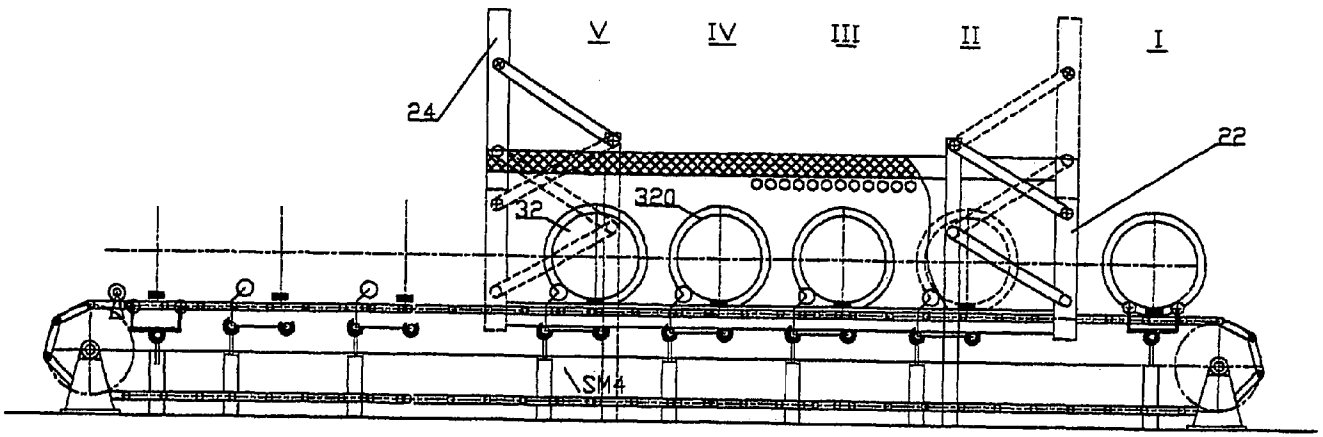
Figure 8:
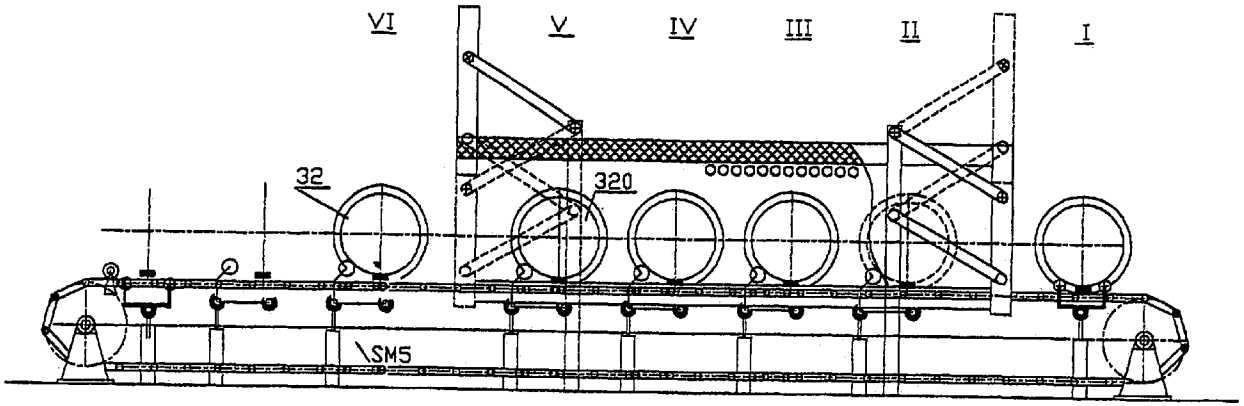

In the beginning of the cycle the inlet door and the outlet door of the heating chamber are closed, the conveyor does not operate. In the initial stage all stopper means are in protruded position. As seen in FIG. 4 the platform 35 is above the conveyor. The conveyor's drive is switched on and fresh container 32 is put on the platform 35 by appropriate lifting device (not shown). This position is referred to as loading position and it is designated in FIG. 4 as I. The power supply is turned on to energize the heating elements and so the pantograph mechanism 26 and cylinder 37 of the platform 9 (see FIG. 1*a*). The platform lowers the container down and puts it on the conveyor, the container approaches the inlet door and it opens to let the container enter the heating chamber. The platform is returned into elevated position and the inlet door is closed. The conveyor advances container 32 until it is stopped by lever 72. In this position container does not advance but rotates about its longitudinal axis and is simultaneously heated in the first heating position up to temperature $T_1$, which is about half of the temperature T, required for initiation of diffusion. This first heating position is designated in FIG. 4 by numeral II and container is shown by dotted lines. The heating time is programmed in advance to be about a half of the whole heating cycle. In practice this time is about 0.5 hour. For controlling the heating time a dedicated timer (not shown) is provided on the control panel. During the heating a second container 320 is put on platform 35 (see FIG. 5). Upon signal, generated by the timer, the first stopper means is brought down by cylinder 66 and first container 32 is now free to advance further along the transportation path until it reaches levers 720 of the stopper means SM2 as shown in FIG. 5. In this second heating position, which is designated in FIG. 5 by numeral III the first container rotates and is simultaneously heated up to temperature T. Stopper means SM1 is returned in the protruded position, the loading platform is brought down, the inlet door is opened and second container, which has been put on the conveyor, enters the heating chamber. The conveyor advances the second container until it reaches first heating position II as shown in FIG. 5 by dotted lines. Once the first container reaches second heating position III the thermocouple is inserted in its bottom to measure temperature within the container. Controller of the power supply is programmed to keep the temperature T in the first container at a level, which is required for reaching steady state diffusion. The heating time up to this temperature is set by a timer to be about 0.5 hour. Once this temperature is reached the thermocouple is taken out, the stopper means SM2 is brought in the lowered position and first container is now free to leave the second heating position. The first container advances forward along the transportation path until it reaches further heating position within the chamber, which is designated in FIG. 6 by numeral IV. In this position the first container is held by the stopper means SM3, which is in protruded position. The first container rotates and is heated at the temperature T for saturation the outside layer of the articles by the diffusion specie. Stopper means is SM1 is brought in lowered position and second fresh container advances from the first heating position to the second heating position. Stopper means SM3 is brought in protruded position and second container is held in the second heating position. The thermocouple is inserted in the second container and it is heated up to the required temperature. Third fresh container is put by the loading platform on the conveyor, the inlet door is opened, and conveyor advances the third container to the first heating position. Stopper means SM1 is brought in protruded position and third container is held in the first heating position as shown by dotted lines in FIG. 6. The inlet door is closed and fourth fresh container is put on the conveyor. Once the required temperature at the second heating position is reached the stopper means SM3 is lowered to let the first container to advance further until it reaches fourth heating position, which is designated in FIG. 7 by numeral V. In this position the first container is held by stopper means SM4 and is heated at the temperature T for saturation the outside layer of the articles by the diffusion specie. The rest of containers advance one position forward similarly to already described procedure until the second container resides in heating position IV, the third container in heating position III, the fourth container in heating position II. It can be readily appreciated that by virtue of this advancement the next fresh container can be brought in the loading position I, as shown in FIG. 7.

After completing the heating cycle, which is required for heating the third container, residing in heating position III, the outlet door is opened, stopper means SM4 is brought in lowered position and conveyor advances the first container until it reaches first cooling position, which is located outside the heating chamber. In this position, which is designated by numeral VI (see FIG. 8) the first container is cooled in open air. The outlet door is closed, stopper means SM4 is brought in protruded position, while stopper means SM1, SM2, SM3 are lowered to allow advancement of containers, residing in the heating chamber, to one position forward. New fresh container is brought to loading position and is ready for entering the heating chamber. After the conveyor has displaced the containers the respective stopper means are brought in the protruded position to retain the containers in these positions.

Figure 9:
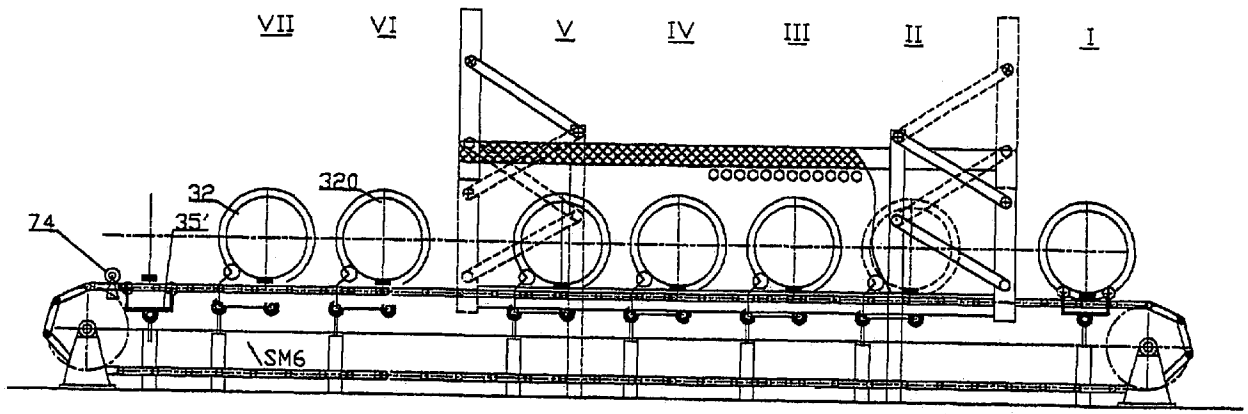
Figure 10:
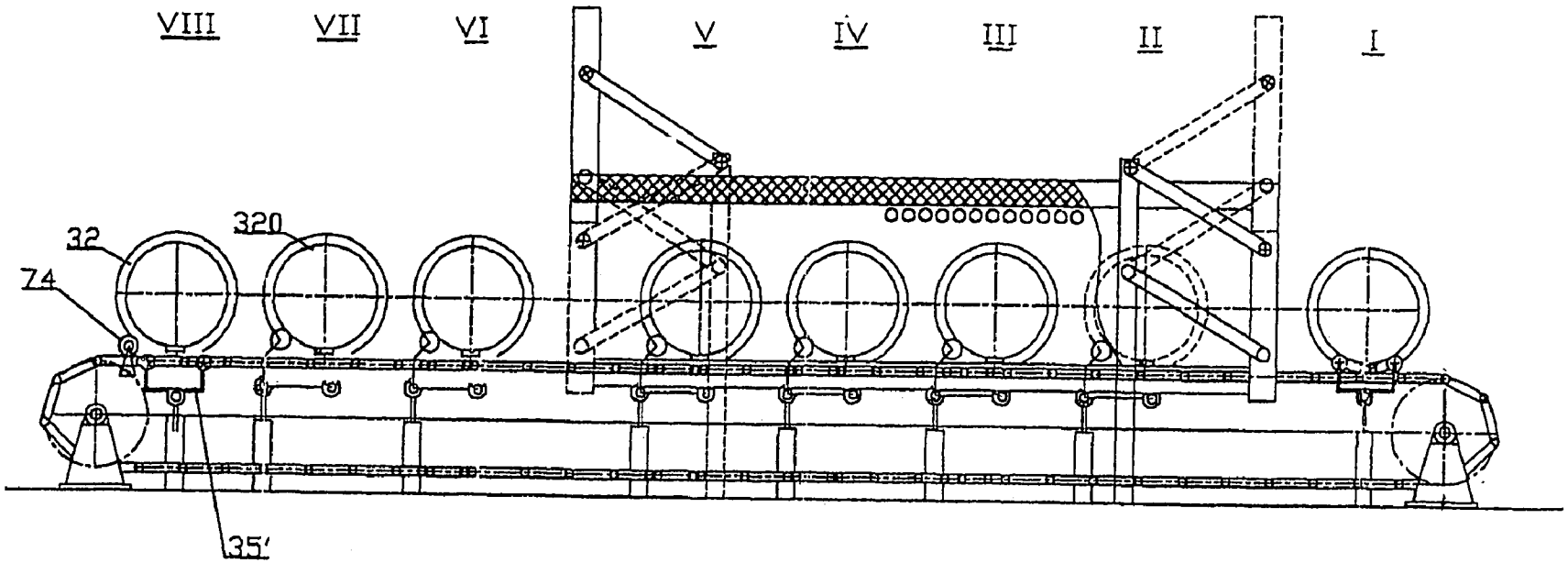

After completing the heating cycle as required for heating the container, residing in position III, the outlet door is opened, stopper means SM4, SM5 are lowered and the first container proceeds to the second cooling position, which is designated in FIG. 9 by numeral VII. The second container proceeds to the first cooling position, which is designated by numeral VI. The outlet door is closed, stopper means SM4, SM5 are brought in protruded position, while the rest of stopper means are lowered to allow advancement of containers, residing in the heating chamber, to one position forward. New fresh container is brought to loading position and is ready for entering the heating chamber. After displacing the containers one position forward the stopper means are brought in protruded position to retain the containers in these positions. Similarly to the above-described procedure the rest of containers are advanced once again to the further position until the first container reaches the unloading position, designated in FIG. 10 by numeral VIII. In this position the processed container is retained by a steady support 74. The processed container is elevated above the conveyor by platform 35'. Appropriate hoist or forklift can now bring the container aside and after removing the cover the coated articles are discharged from the container.

The above-described sequence of steps allows continuous processing of all containers by advancing them from the loading position I up to unloading position VIII. The advancement of containers is intermittently stopped and containers are retained in their current positions by stopper means for heating up to required temperature or holding at required temperature during certain time.

It is not shown in the drawings, but should be understood, that the apparatus is provided with automatic control system, which is capable to perform the following:

- To block the drive of the loading platform when the inlet door is closed
- To switch off the heating elements when the conveyor stops
- To prevent lowering of the stopper means SM5 when the outlet door is closed
- To block opening of the inlet door if a container resides in position II
- To block lowering of the stopper means SM2, SM3, SM4, SM5 as far the previous position is occupied by a container.

The above description referred to manual mode of operation. In the automatic mode the apparatus functions as follows. Conveyor's drive is switched on; first fresh container is brought on the loading platform. Sensing means detects container on the platform and generates signal, which energizes the inlet door drive. The inlet door opens and platform puts first container on the conveyor. Container proceeds forward, enters heating chamber and reaches first heating position II. Sensing means, which is associated with position II detects container and generates a signal, which closes the inlet door. Simultaneously a signal for elevating the platform is generated and a signal for switching on the timer for heating position II. The time for heating in this position is programmed to be about a half of the whole heating cycle. In practice this heating time is 25–30 min.

Power supply for all or part of the heating elements is switched on manually before the conveyor is switched on. If, however this has not been done the sensing means of position II switches on the heating elements referring to this position and all or part of the heating elements referring to heating position III. The required amount of heating elements to be switched on after the first container reaches position II is established empirically when the furnace is tested.

When the first container is being heated in the first heating position a second fresh container is put on the loading platform. Once the heating time is over the timer switches on the cylinder of stopper means SM1 to bring it in lowered position. Container is free to advance further and it reaches second heating position III, in which it is retained by stopper means SM2. For controlling heating cycle in position III a controller e.g. Eurotherm is provided, and a timer. Sensing means, referring to position III switches on the controller, the timer and cylinder of stopper means SM1 to bring it in protruded position. A thermocouple is inserted within the bottom of the first container for measuring temperature if its interior. Sensing means referring to position II switches on pantograph mechanism of the inlet door and it opens. The loading platform is brought in lowered position and second fresh container is put on the conveyor. The conveyor advances the second container from the loading position I to the first heating position II. The inlet door closes and loading platform is elevated. Third fresh container is put on the loading platform and is ready for loading on the conveyor.

Upon reaching required temperature within the first container and after elapsing the required heating time the controller generates a signal, which brings stopper means SM2 in lowered position. The first container advances from heating position III to the next heating position IV, in which it is retained by stopper means SM3. Advancement of the first container in the next position is allowed only when two conditions are satisfied, i.e. the required temperature is reached and the required heating time is elapsed. If the temperature is reached before elapsing the heating time, the controller switches off at least part of the heating elements. In this situation the first container is allowed to advance only after the heating time is elapsed. When sensing means, referring to position IV detects presence of the first container it switches on cylinder of stopper means SM2 to bring it in protruded position. The second container advances from position II to position III and retains therein by virtue of stopper means SM2. The loading platform lowers, places on the conveyor the next fresh container and it proceeds from the loading position towards first heating position II. After the heating cycle, referring to position III is completed the controller generates a signal, which lowers stopper means SM3. Now the first container is free to advance from position IV to position V. The rest of containers displace one position forward in accordance with the above-described procedure.

Each time, when the heating cycle associated with position III is completed a signal is generated, which activates pantograph mechanism 28 and it opens the outlet door 24. It is not shown specifically, but should be understood that there is provided also a sensor, which detects upper position of the door and when the door is brought in this position a signal is generated, which causes lowering the stopper means SM4. By virtue of this provision the container, which is currently retained in position V is free to advance further and exit from the heating chamber. This container reaches first cooling position VI and is retained therein by stopper means SM5. Upon detecting by the sensing means of presence of the container in this position a signal is generated, which activates pantograph mechanism and it closes the outlet door. The further advancement of containers is carried out similarly to described-above procedure. The apparatus is provided with automatic control circuit, which is designed in such a manner that controller generates appropriate signal for lowering stopper means referring to the last occupied position and only after that the containers can be advanced by the conveyor to the next positions.

Once the processed container reaches position VIII and is retained therein by steady support 74 a signal is generated by the sensing means to activate the unloading platform, which elevates the processed container above the chains. Appropriate hoist unloads the processed container from the platform.

Now with reference to non-limiting example 1 it will be explained the advantages of the present invention in comparison with commercially available thermal diffusion coating furnaces, operating periodically.

EXAMPLE 1

Zinc thermal diffusion coating was applied on small articles, made of low carbon steel. The articles were loaded in containers together with powder mixture, containing Zinc powder as diffusion specie. The mass of articles in one container was 1000 kg. Closed containers with the articles were thermally treated in the apparatus of the invention, operating continuously and provided with discrete positions as described above. The containers were heated in heating position II during 0.5 hour until temperature $T_1$ within the containers reaches 190–210 Degrees C. and then in heating position III until temperature T within the containers reaches 380–420 Degrees C. This temperature corresponds to steady-state diffusion. After that the containers were advanced to heating position III and IV and held in these positions for about 0.5 hour at temperature T to reach saturation of the surface layer by the diffusion specie. The whole process cycle took 2 hours. Capacity of the furnace with four discrete positions within the heating chamber was 2 containers per hour or 2000 articles per hour. For comparison capacity of a periodically operating furnace, suitable for processing containers of the same size is 500 articles per hour. In other words for processing of the same amount of articles it would be required four periodically operating furnaces.

It should be also mentioned, that maintenance of separate periodically operating furnaces requires much more time and labor, since periodically operating furnaces are less suitable for automation and mechanization. Furthermore, several periodically operating furnaces require 2.5–3 times more space, than one continuous furnace.

By virtue of the present invention it is possible to carry out the process efficiently and at the same time to ensure accurate control of the process parameters individually with respect to each position.

It should be understood that the present invention should not be limited to the above described example and embodiments. One ordinarily skilled in the art can make changes and modifications without deviation from the scope of the invention.

The scope of the present invention is defined in the appended claims.

However it should be understood that the features disclosed in the foregoing description, in the following claims and/or accompanying examples may separately and in any combination thereof, be material for realizing the present invention in diverse forms thereof.

The invention claimed is:

1. An apparatus for obtaining thermal diffusion coating on the outside surface of articles of manufacture, capable upon heating to diffuse within the articles' surface, said apparatus comprising:

a) articles embedded in a powder mixture and containing a specie, b) a closed tubular container retaining said articles, c) thermal treatment chamber suitable for placing thereinto of at least one container with the said articles and heating thereof up to the temperature sufficient to initiate and maintain the said diffusion, said thermal treatment chamber is configured as a tunnel defined by parallel lateral walls, by a bottom and by a ceiling, the interior of said tunnel is provided with a heating zone heated by heating means, said chamber is closed at one end thereof by an inlet door and at the opposite end thereof by an outlet door, d) advancement means, capable to continuously advance the container along the transportation path so as to bring it within the tunnel, to advance it along the tunnel and to evacuate it from the tunnel, e) at least one stopper means situated in a discrete position along the transportation path, said stopper means are capable to intermittently prevent the advancement of the container along the transportation path and to cause rotation thereof about its longitudinal axis once the container approaches the stopper means, f) a source of energy for energizing the heating means, and g) control means for controlling said thermal treatment chamber, said advancement means, said at least one stopper means and said source of energy.

2. The apparatus as defined in claim 1, in which said advancement means comprises a chain conveyor consisting of at least two spaced apart parallel branches extending along the transportation path and passing through corresponding parallel slots made in the bottom of the tunnel.

3. The apparatus as defined in claim 2, in which said container comprises a cylinder, said cylinder is defined by a bottom wall and by a periphery wall, said cylinder is closed by a cover, the periphery wall of said cylinder is provided with two spaced apart annular protrusions, said protrusions are adapted to rest on the branches of the conveyor during advancement of the container along the transportation path and to keep the container directed perpendicularly to the longitudinal axes of the tunnel.

4. The apparatus as defined in claim 3, in which said stopper means comprises two substantially L-shaped levers, said levers are defined by their first and second ends, said levers are spaced apart and rigidly secured by their first ends on a common axle, which is directed perpendicular to the longitudinal axis of the tunnel, said axle is mounted under the bottom of the tunnel and capable of turning, wherein turning the axle is associated with pivoting the levers and protruding their second ends through the bottom of the tunnel towards the cylinder's periphery.

5. The apparatus as defined in claim 4, in which the second ends of the levers are provided with rotatable rollers.

6. The apparatus as defined in claim 4, in which said axle is connected to a rod displaceable by a cylinder, wherein displacement of the rod causes turning of the axle.

7. The apparatus as defined in claim 6, in which said discrete position is provided with a sensing means for detecting the presence of the container in the said position.

8. The apparatus as defined in claim 7, in which said chamber is provided with at least one temperature sensing means.

9. The apparatus as defined in claim 8, in which said temperature-sensing means comprises a thermocouple, protruding through the lateral wall of the tunnel towards the interior thereof.

10. The apparatus as defined in claim 1, in which said transportation path comprises a plurality of discrete positions, said discrete positions comprise a loading position, situated in the beginning of the transportation path, at least one heating position, situated within the tunnel, at least one cooling position, situated beyond the outlet door and an unloading position, situated in the end of the transportation path.

11. A method for obtaining thermal diffusion coating on the outside surface of articles of manufacture by heating thereof within a furnace, while said articles are placed within a closed tubular container filled with a powder mixture, containing a specie, capable upon heating to diffuse within the surface of said articles, the said method comprises: a) continuous advancement of the closed container along a transportation path so as to bring the said container within the furnace, to heat it therein and to evacuate it therefrom, said advancement is carried out in such a manner that the container is directed perpendicularly to the longitudinal axis of the furnace b) intermittent preventing of the said advancement along the transportation path and c) rotation movement of the container about its longitudinal axis when the said advancement is prevented, wherein said containers are continuously advanced between discrete positions, situated along the transportation path, said advancement is intermittently prevented once the containers reach each of the discrete positions and said discrete positions comprise a loading position, at least one heating position, at least one cooling position and an unloading position, all of which are discrete from one another, and further wherein said containers are heated in a first heating position until a temperature $T_1$ is established within the containers, which is about half of the temperature T, required for diffusion of the specie within the outside surface of the articles and said containers are advanced from the first heating position to a second heating position after the said temperature $T_1$, is reached.

12. The method as defined in claim 11, in which said articles are placed within a plurality of containers.

13. The method as defined in claim 11 in which said containers are heated in the second heating position until within the containers establishes said temperature T.

14. The method as defined in claim 13, in which said containers are advanced from the second heating position to a further heating position and are held in this position at the temperature T during period of time, sufficient for saturating the surface of the articles by the diffusing specie.

15. The method as defined in claim 14, in which said diffusing specie is Zinc and said temperature T is 380–420 degrees C.

* * * * *